US008303718B2

(12) United States Patent
Kim et al.

(10) Patent No.: US 8,303,718 B2
(45) Date of Patent: Nov. 6, 2012

(54) STERILIZABLE WASHING MACHINE USING ULTRAVIOLET RADIATION AND STERILIZABLE WASHING METHOD IN THE SAME

(75) Inventors: Young-Soo Kim, Changwon-si (KR); Soung-Bong Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/167,613

(22) Filed: Jun. 23, 2011

(65) Prior Publication Data

US 2011/0252578 A1 Oct. 20, 2011

Related U.S. Application Data

(62) Division of application No. 12/094,102, filed on Nov. 17, 2008.

(30) Foreign Application Priority Data

Nov. 18, 2008 (KR) ..... 10-2005-0110995
Nov. 18, 2008 (KR) ..... 10-2005-0110996

(51) Int. Cl.

| | |
|---|---|
| ***B08B 3/06*** | (2006.01) |
| ***B08B 3/10*** | (2006.01) |
| ***D06F 39/06*** | (2006.01) |
| ***A61L 2/10*** | (2006.01) |

(52) U.S. Cl. ..... 134/1; 134/26; 134/29; 134/33; 134/34; 8/159; 8/137; 8/158; 422/24

(58) Field of Classification Search ..... 8/159, 137, 8/158; 134/1, 33, 34, 29; 422/24
See application file for complete search history.

(56) References Cited

U.S. PATENT DOCUMENTS

| | | | | |
|---|---|---|---|---|
| 2,293,618 | A | 8/1942 | Howard et al. | |
| 4,182,050 | A * | 1/1980 | Righi | 34/60 |
| 5,664,340 | A | 9/1997 | Brown | |
| 5,869,932 | A | 2/1999 | Choi | |

(Continued)

FOREIGN PATENT DOCUMENTS

| | | | |
|---|---|---|---|
| CN | 2687554 | Y | 3/2005 |

(Continued)

OTHER PUBLICATIONS

Machine translation; JP 10-43481; Asai, T., Feb. 17, 1998.*

*Primary Examiner* — Michael Barr
*Assistant Examiner* — Natasha Campbell
(74) *Attorney, Agent, or Firm* — Birch, Stewart, Kolasch & Birch, LLP

(57) ABSTRACT

The present invention discloses a sterilizable washing machine using ultraviolet radiation, and a sterilizable washing method in the same. The sterilizable washing machine includes a cabinet (2) having an inlet for putting the laundry into the washing machine, a door (50) installed at the cabinet (2), for opening and closing the inlet of the cabinet (2), a tub (6) installed in the cabinet with a buffing function and containable wash water, a drum (8) rotatably installed inside the tub (6) for performing washing, a gasket G installed between the inlet of the cabinet (2) and the tub (6), for sealing the gap between the door (50) and the tub (6), and an ultraviolet light source (20) installed at the gasket (6), for radiating ultraviolet rays into the drum (8).

8 Claims, 2 Drawing Sheets

U.S. PATENT DOCUMENTS

| | | | | |
|---|---|---|---|---|
| 6,877,248 | B1 | 4/2005 | Cross et al. | |
| 2005/0257573 | A1 | 11/2005 | Henssler et al. | |
| 2006/0057020 | A1 * | 3/2006 | Tufo | 422/24 |
| 2006/0125428 | A1 * | 6/2006 | Schulze et al. | 318/53 |

FOREIGN PATENT DOCUMENTS

| | | | |
|---|---|---|---|
| DE | 21 10 063 | A1 | 9/1972 |
| DE | 297 17 295 | U1 | 3/1999 |
| EP | 711860 | A1 * | 5/1996 |
| EP | 1 602 774 | A1 | 12/2005 |
| JP | 10043481 | A * | 2/1998 |
| JP | 2000-157781 | A | 6/2000 |
| JP | 2005-253786 | A | 9/2005 |
| WO | WO 2004025012 | A1 * | 3/2004 |

* cited by examiner

[Fig. 1]
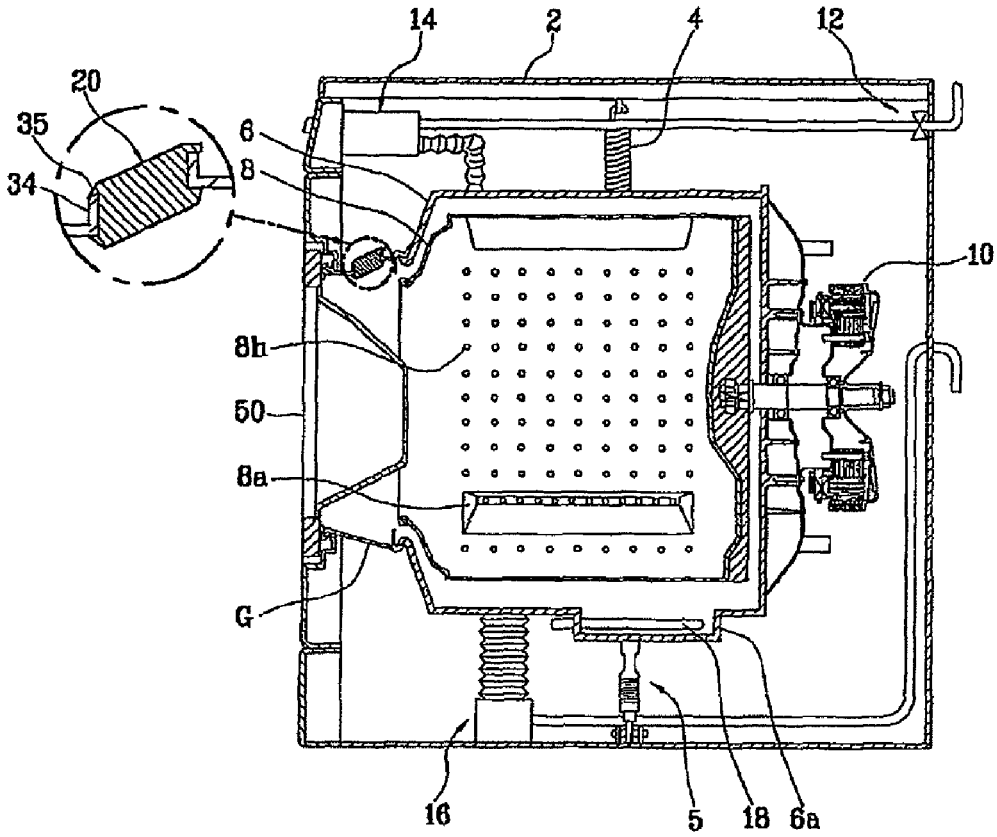
[Fig. 2]
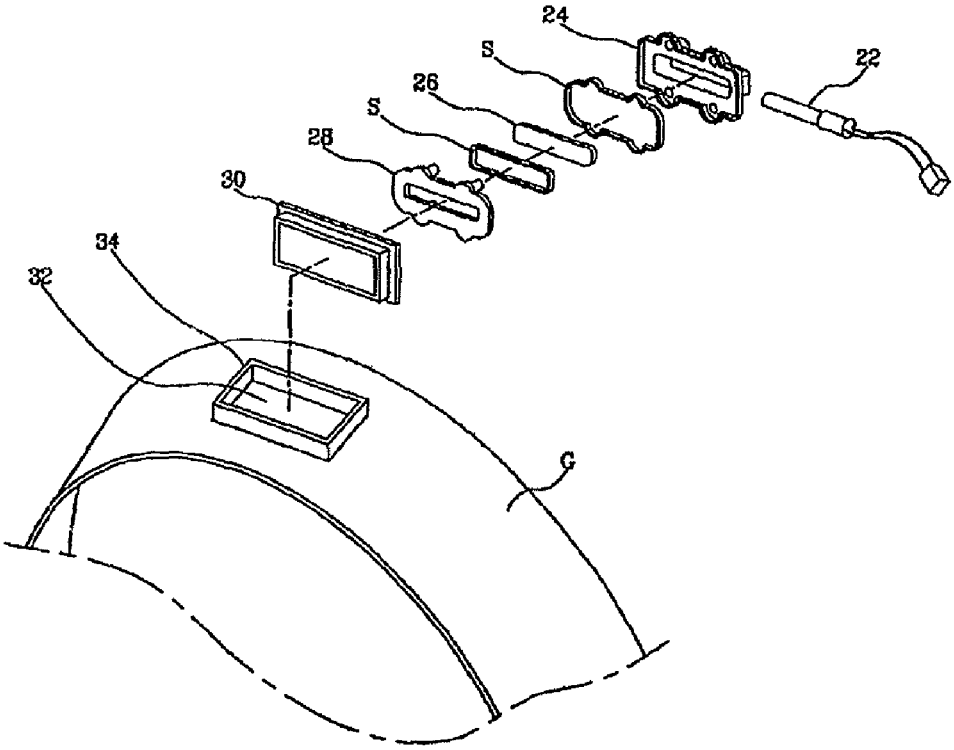

[Fig. 3]
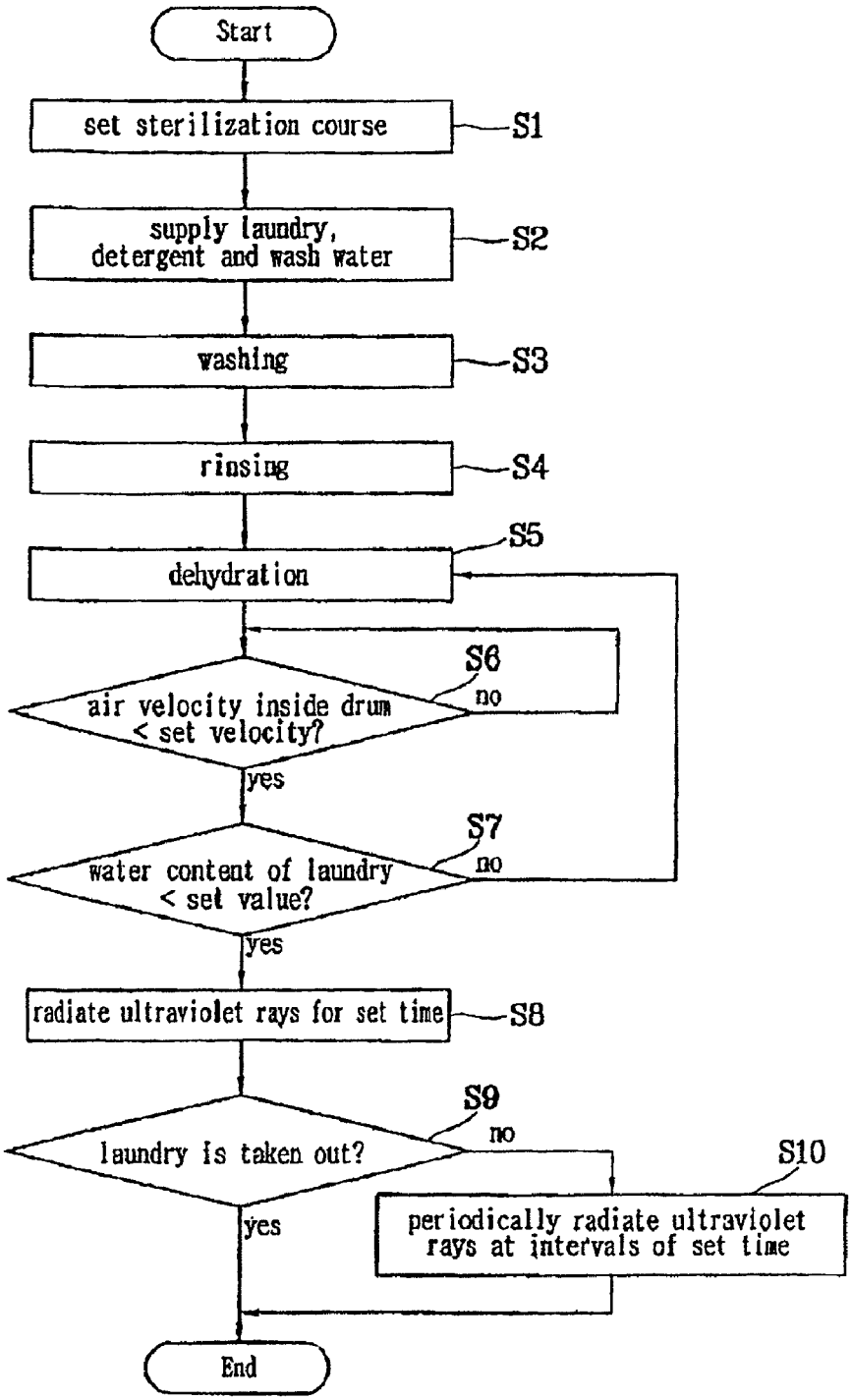

STERILIZABLE WASHING MACHINE USING ULTRAVIOLET RADIATION AND STERILIZABLE WASHING METHOD IN THE SAME

This application is a Divisional of co-pending application Ser. No. 12/094,102, filed on Nov. 17, 2008, the entire contents of which are hereby incorporated by reference and for which priority is claimed under 35 U.S.C. §120.

TECHNICAL FIELD

The present invention relates to a sterilizable washing machine using ultraviolet radiation and a sterilizable washing method in the same, and more particularly, to a sterilizable drum type washing machine using ultraviolet radiation which can perform sterilization by radiating ultraviolet rays into a drum, and a sterilizable washing method in the same.

BACKGROUND ART

In general, in a state where detergent, wash water and laundry are put into a tub and a drum installed on the same level, a washing machine washes the laundry by using friction between the laundry and the drum rotated by driving force of a motor. The washing machine provides washing effects such as beating and rubbing without damaging or tangling the laundry.

Normally, tap water is used as the wash water and supplied into the tub and the drum with the detergent, for washing the soiled laundry. Calcium of the tap water and a surfactant of the detergent react with each other, thereby to generate insoluble metal soap. The metal soap easily sticks to the inner wall of the drum. It more frequently occurs in powder detergent containing high fatty acid sodium.

The metal soap remaining in the laundry sticks to fiber remnants or dirties separated from the laundry and absorb moisture, thereby to propagate microorganisms. In addition, the metal soap elements may generate floccules causing rot, and may also generate molds causing bad smell. Furthermore, the molds are grown to float in the water and stick to the laundry in the washing process. As a result, even if the soiled laundry is washed, it does not mean that the laundry is sanitary.

Various germs existing in the air such as *Staphyllococcus aureus, Bacillus cereus* and *Atypical mycobacterium* are easily adhered to clothes while being clothed. Even after the clothes are washed by the washing machine, such germs still remain in the clothes. Especially, if the clothes are not sufficiently dried, the remaining germs propagate themselves, generate unpleasant smell and discolor the clothes. If sick persons, babies or children having weak immunity wear the clothes in which the germs remain, they may have health problems like a skin disease.

DISCLOSURE OF INVENTION

Technical Problem

An object of the present invention is to provide a sterilizable washing machine using ultraviolet radiation which can perform sterilization by radiating ultraviolet rays to the laundry under predetermined conditions during washing, and a sterilizable washing method in the same.

Technical Solution

There is provided a sterilizable washing machine using ultraviolet radiation, comprising: a cabinet having an inlet for putting the laundry into the washing machine; a door installed at the cabinet, for opening and closing the inlet of the cabinet; a tub installed in the cabinet with a buffing function and capable of containing wash water; a drum rotatably installed inside the tub, for performing washing; a gasket installed between the inlet of the cabinet and the tub, for sealing the gap between the door and the tub; and an ultraviolet light source installed at the gasket, to radiate ultraviolet rays into the drum.

In the washing machine using the rotating drum and containing the wash water, it is difficult to install the ultraviolet light source not to be affected by rotation of the drum and not to contact the wash water. To solve the above problem, the present invention installs the ultraviolet light source at the gasket between the door and the tub. In addition, there is provided a sterilizable washing method using ultraviolet radiation in a washing machine for washing the laundry by rotation of a drum through a washing process including a water supply step, a washing step, a drainage step, a rinsing step, and a dehydration step, comprising: a sterilization step for sterilizing the laundry by ultraviolet radiation after the dehydration step.

Various types of light sources such as an ultraviolet lamp and an ultraviolet light emitting diode can be used as the ultraviolet light source. Any kinds of sterilizable ultraviolet light sources can be used. The ultraviolet rays are classified into A (300 to 400 nm), B (280 to 320 nm) and C (180 to 280 nm) by wavelengths. The ultraviolet rays of C region (180 to 280 nm) are known to kill microorganisms. Accordingly, preferably, the ultraviolet light source radiates ultraviolet rays having a wavelength of 180 to 280 nm.

In another aspect of the present invention, the sterilization step is accompanied with rotation of the drum. The rotation of the drum serve to evenly shake up the laundry and radiate the ultraviolet rays to the whole laundry.

In another aspect of the present invention, the ultraviolet rays are additionally radiated in at least one step of the washing process. It means that the ultraviolet radiation can be applied to any step of the washing process by selection of the user.

In another aspect of the present invention, the dehydration step is finished when at least one of an air flow velocity inside the drum and a water content is below set values.

BRIEF DESCRIPTION OF THE DRAWINGS

The present invention will become better understood with reference to the accompanying drawings which are given only by way of illustration and thus are not limitative of the present invention, wherein:

FIG. 1 is a side-sectional view illustrating a washing machine in accordance with an embodiment of the present invention;

FIG. 2 is a disassembly view illustrating an example of coupling of an ultraviolet lamp assembly and a gasket; and FIG. 3 is a flowchart showing sequential steps of a sterilization control method of a sterilizable apparatus for the washing machine in accordance with an embodiment of the present invention.

MODE FOR THE INVENTION

A sterilizable washing machine using ultraviolet radiation and a sterilizable washing method in the same in accordance with the present invention will now be described in detail with reference to the accompanying drawings.

FIG. 1 is a side-sectional view illustrating the washing machine in accordance with the present invention. The washing machine comprises a cabinet 2 forming the external appearance, a tub 6 installed to hang in the cabinet 2 by a spring 4 and to be supported by a damper assembly 5, a drum 8 rotatably installed inside the tub 6 and containable wash water and laundry, a motor 10 installed at the rear side of the tub 6 to be connected with the drum 8, for rotating the drum 8, and a door 50 installed near an inlet of the cabinet 2, for opening and closing the inlet. A ring-shaped gasket G is installed to connect the inlet of the cabinet 2 to the tub 6. An ultraviolet lamp assembly 20 for generating ultraviolet rays is installed at the top of the gasket G to face the inside of the drum 8, to radiate the ultraviolet rays into the drum 8 to sterilize the laundry.

The washing machine further includes a water supply valve assembly 12 and a detergent box assembly 14 installed at the upper portion of the tub 6, for supplying wash water and detergent into the tub 6 and the drum 5, a drain pump assembly 16 installed at the lower portion of the tub 6, for discharging the wash water from the tub 6 and the drum 8, a heater 18 mounted on a heater mounting unit 6*a* protruded downwardly from the lower portion of the tub 6, for heating the wash water in the tub 6 at a high temperature to improve washing performance, and a control means (not shown) for controlling the operations of the motor 10, the heater 18 and the ultraviolet lamp assembly 20.

Here, the door 50 is hinge-coupled to open and close the inlet formed at the front surface of the cabinet 2. When the cabinet 2 is closed with the door 50, the door 50 is closely adhered to the inlet, for preventing leakage of wash water. The tub 6 can be formed into a cylindrical shape and installed horizontally inside the cabinet 2. In addition, in order to easily take the laundry out through the inlet of the cabinet 2, the front end of the tub 6 can be more upwardly inclined in the cabinet 2 than the rear end of the tub 6.

The drum 8 is formed into a cylindrical shape and rotatably installed inside the tub 6. A plurality of dehydration holes 8*h* are formed at the inner wall of the drum 8, so that the wash water can freely flow in and out of the drum 8 and the tub 6, and discharged from the laundry by centrifugal force in a dehydration step. Lifters 8*a* are protruded from the inner wall of the drum 8 at a predetermined interval, for lifting up and dropping the laundry by rotation of the drum 8.

Preferably, the drum 8 is made of stainless steel to reflect the ultraviolet rays, so that the ultraviolet rays can reach every part in the drum 8. The drum 8 is connected to the motor 10 mounted at the rear side of the tub 6 by a motor shaft (not shown) installed to pass through the tub 6, for receiving power. The motor 10 reverses the drum 8 alternately clockwise and counterclockwise, and rotates at a speed having centrifugal force below 1 G (1 gravity), for widely transmitting sterilization effects of the ultraviolet rays.

The water supply valve assembly 12 and the drain pump assembly 16 include a water supply valve (not shown) and a drain pump (not shown) and supply and discharge the wash water by the operations of the water supply valve and the drain pump, respectively. The operations of the water supply valve and the drain pump are controlled by the control means.

The ultraviolet lamp assembly 20 can be coupled to the gasket G in various ways. Preferably, the ultraviolet lamp assembly 20 is shape-coupled to the rubber gasket G having a ring-shaped protrusion 34. In order to firmly fix the shape coupling, the ultraviolet lamp assembly 20 may further include a shape fixing means 35. The shape fixing means 35 is formed on one or both sides of the ultraviolet lamp assembly 20, for reinforcing coupling of the gasket G and the ultraviolet lamp assembly 20, and preventing water leakage from the coupling portion of the gasket G and the ultraviolet lamp assembly 20. In addition, the gasket G and the ultraviolet lamp assembly 20 can be fixed by using a band or taping.

On the other hand, instead of the ultraviolet lamp assembly 20, an ultraviolet light emitting diode can be used as the ultraviolet light source. The ultraviolet light emitting diode is more advantageous in reliability and power consumption than the ultraviolet lamp assembly 20.

FIG. 2 is a disassembly view illustrating another example of coupling of the ultraviolet lamp assembly 20 and the gasket G. The ultraviolet lamp assembly 20 includes an ultraviolet lamp 22 for generating the ultraviolet rays according to a control signal from the control means, a housing main body 24 on which the ultraviolet lamp 22 is settled, a transmitting plate 26 for transmitting the ultraviolet rays generated by the ultraviolet lamp 24, and a housing cover 28 mounted on the front surface of the housing main body 24. The ultraviolet rays are evenly radiated into the drum 8 as well as the laundry, thereby sterilizing the drum 8 and the laundry together.

Generally, the transmitting plate 26 is made of a quartz plate which can transmit the ultraviolet rays, and thus fragile even by slight impact. To solve this problem, before the transmitting plate 26 is installed between the housing main body 24 and the housing cover 28 with the ultraviolet lamp 22, a pair of sealing members S are coupled to the peripheral portions of the front and rear surfaces of the transmitting plate 26. Preferably, the sealing members S are made of rubber in a ring shape, and installed respectively between the housing main body 24 and the transmitting plate 26, and between the transmitting plate 26 and the housing cover 28.

On the other hand, a settling groove (not shown) is formed at the housing main body 24, so that the ultraviolet lamp 22 can be slidably inserted into the settling groove from the side portion. The housing cover 28 is coupled to the housing main body 24. A transmitting hole is formed at the center of the front surface of the housing cover 28, for transmitting the ultraviolet rays generated by the ultraviolet lamp 22. The periphery of the housing cover 28 is screw-coupled to the periphery of the housing main body 24.

The ultraviolet lamp assembly 20 is installed in the settling hole 32 formed by the protrusions 34 on the top of the gasket G, and thus coupled to the gasket G.

The ultraviolet lamp assembly 20 can be installed directly in the settling hole 32, or installed in the settling hole 32 being settled on a special mounting member 30.

Since a diameter of the tub 6 is larger than a diameter of the inlet of the cabinet 2, a diameter of the gasket G is increased from the front to rear end. The settling hole 32 formed at the top of the gasket G faces the drum 8 identically to the top of the gasket G. Therefore, the ultraviolet lamp assembly 20 supported by the settling hole 32 and the supporting protrusions 34 automatically faces the drum 8.

Even if the inlet of the cabinet 2 and the tub 6 have the same diameter, if the drum 8 is downwardly inclined from the front to rear end, the settling hole 32 horizontally installed at the top of the gasket G faces the drum 8. As a result, the ultraviolet lamp assembly 20 supported by the settling hole 32 and the supporting protrusions 34 automatically faces the drum 8.

On the other hand, the ultraviolet rays can be radiated into the drum 8, by controlling a radiation angle of the ultraviolet lamp assembly 20 or the ultraviolet light emitting diode, regardless of the structure of the gasket G.

The present inventors considered a wavelength of ultraviolet rays, a humidity inside the washing machine, and an air flow velocity inside the drum as factors influencing sterilization effects in sterilizing the laundry in the washing machine by ultraviolet radiation, and found out that the ultraviolet rays having a wavelength of 180 to 200 nm, the low humidity inside the washing machine (relative humidity below 60%) and the low air flow velocity inside the drum (equal to, or lower than 2 in/sec) were advantageous in sterilization. It is thus preferable to form the above conditions in the washing machine for the ultraviolet radiation. Here, the wavelength of the ultraviolet rays can be adjusted by using the ultraviolet light source having the wavelength, and the air flow velocity inside the drum can be adjusted by controlling the rotation speed of the drum. Generally, a sensor for sensing a relative humidity is not installed in the washing machine. Therefore, when a predetermined humidity (for example, below 40%) is sensed by a sensor for sensing a humidity, the ultraviolet radiation can be carried out.

In addition, the transmitting plate 26 must be considered in using the ultraviolet lamp assembly 20. The transmitting plate 26 is installed to protect the ultraviolet lamp 22. Since most of materials (for example, plastic) do not transmit the ultraviolet rays, the transmitting plate 26 is made of an ultraviolet ray transmitting material such as quartz.

The sterilization in the washing process in accordance with the present invention will now be explained.

The control means is connected to operation buttons (not shown) installed at the cabinet 2, for controlling the operations of the motor 10, the heater 18, the water supply valve or the drain pump, and the ultraviolet lamp 22 by course selection of the user.

Especially, when the user selects a sterilization course, the control means enables the ultraviolet lamp 22 to radiate the ultraviolet rays during a rinsing step or after a dehydration step. During the ultraviolet radiation, the control means controls the operation of the motor 10 to reverse the drum 8 clockwise and counterclockwise, for evenly shaking up and sterilizing the laundry.

Preferably, the control means slowly rotates the drum 8 at a speed having centrifugal force below 1 G during the sterilization by driving the motor 10, thereby sufficiently sterilizing the laundry.

The control means senses opening/closing of the door 50. Preferably, when the door 50 is opened, the control means stops the operation of the ultraviolet lamp 22, thereby preventing leakage of ultraviolet rays.

Normally, when the velocity of the ambient air flow exceeds a set velocity or the relative humidity exceeds a set value, the sterilization effects of the ultraviolet rays are reduced. Accordingly, when the air flow velocity inside the drum 8 is over the set velocity or the water content is over the set value, the control means can stop the ultraviolet radiation of the ultraviolet lamp 22.

In this case, the control means is connected to a sensor for sensing an air flow velocity inside the drum 8 and a sensor for sensing a water content, for receiving sensed values and deciding ultraviolet radiation according to the sensed values.

After the washing process, the control means decides whether the laundry has been taken out by opening of the door 50. If the user does not take the laundry out over a set time, the control means controls the ultraviolet lamp 22 to periodically radiate the ultraviolet rays at intervals of a predetermined time, thereby continuously sterilizing the laundry.

FIG. 3 is a flowchart showing sequential steps of a sterilization control method of a sterilizable apparatus for the washing machine in accordance with an embodiment of the present invention. The sterilization control method of the washing machine will now be described with reference to FIG. 3.

In a first process, the user sets a sterilization course, puts the laundry into the washing machine, and supplies the detergent and the wash water, thereby starting a washing step (refer to S1 to S3).

The user puts the laundry into the washing machine through the inlet of the cabinet, and sets a washing course by using the operation buttons. Here, the user can selectively set the sterilization course. After the user sets the washing course including the sterilization course, the laundry is washed by a pre-inputted washing process.

In detail, the control means senses a quantity of laundry by reversing the drum clockwise and counterclockwise by driving the motor according to the control signal, and supplies the wash water into the tub and the drum through the detergent box assembly by opening the water supply valve. Therefore, the wash water and the detergent are supplied into the tub and the drum in precise amounts.

The control means wets the laundry and dissolves the detergent by repeatedly reversing the drum clockwise and counterclockwise. Thereafter, the control means washes the laundry by rotating the drum in one direction or alternately reversing the drum clockwise and counterclockwise.

As the drum is rotated, the laundry is hooked on the lifter, lifted up and dropped, which gives beating and rubbing effects.

In a second process, a rinsing step and a dehydration step are sequentially performed after the washing step of the first process (refer to S4 and S5).

The used wash water in the tub and the drum are externally discharged by the operation of the drain pump. New wash water is supplied into the tub and the drum in a precise amount by opening the water supply valve. The drum is alternately reversed clockwise and counterclockwise, for rinsing the laundry. This procedure is repeated two or three times.

The laundry is intermittently dehydrated during the rinsing step. Therefore, the sterilization course can be set to be conducted after intermittent dehydration of the rinsing step.

After the rinsing step, the used wash water is externally discharged by the operation of the drain pump. Thereafter, the dehydration step to discharge the wash water contained in the laundry by the centrifugal force is performed by rotating the drum at a high speed in one direction. The rotation speed of the motor is set much higher in the dehydration step than the washing step and rinsing step.

In a third process, a sterilization step is performed after the dehydration step of the second process by radiating the ultraviolet rays for a set time, preferably, in consideration of the air flow velocity inside the drum and the water content (refer to S6 to S8).

The control means receives the sensed air flow velocity inside the drum and the sensed water content, and compares them with the set velocity and the set value.

If the air flow velocity inside the drum is below the set velocity, the control means compares the sensed water content with the set value. If the air flow velocity inside the drum is over the set velocity, the sterilization effects are seriously reduced. In this case, the control means does not start the sterilization step, and continuously senses the air velocity inside the drum.

If the sensed water content is below the set value, the control means starts the sterilization step, and if the sensed water content is over the set value, the control means does not start the sterilization due to bad sterilization effects, and repeats the dehydration step by rotating the drum at a high speed.

Accordingly, when the air velocity inside the drum is below the set velocity and the water content is below the set value, the control means supplies power to the ultraviolet lamp to generate the ultraviolet rays and radiate the ultraviolet rays into the drum. Even though the ultraviolet rays are radiated directly to the laundry in the drum or to the drum, the drum made of stainless steel reflects the ultraviolet rays. As a result, the ultraviolet rays are evenly radiated to every part in the drum, thereby sterilizing the laundry and the drum at the same time.

During the ultraviolet radiation, the control means shakes up the laundry by slowly reversing the drum clockwise and counterclockwise at a speed having centrifugal force below 1 G (if the centrifugal force is over 1 G, the laundry is rotated, sticking to the drum). Therefore, the ultraviolet rays can evenly sterilize the laundry.

In a fourth process, when the user does not take the laundry out after the sterilization step of the third process, the ultraviolet rays are periodically radiated to the laundry at intervals of a set time (refer to S9 and S10).

After finishing the all washing course and the sterilization step, the control means decides whether the laundry has been taken out by opening of the door. If the user does not take the laundry out over the set time, the control means does not let the laundry as it is but sterilizes the laundry by periodically radiating the ultraviolet rays at intervals of the set time.

As discussed earlier, in accordance with the present invention, the sterilizable washing machine using ultraviolet radiation and the sterilizable washing method in the same perform sterilization, by mounting the ultraviolet light source at the top of the gasket installed between the inlet of the cabinet and the tub, and radiating the ultraviolet rays generated by the ultraviolet light source into the laundry inside the drum. The ultraviolet light source is easily mounted to generate the specific wavelength of ultraviolet rays having excellent sterilization effects. Furthermore, the sterilizable washing machine using ultraviolet radiation and the sterilizable washing method in the same can maximize the sterilization effects on the laundry and the drum, by radiating the ultraviolet rays to the laundry and the drum in consideration of the air flow velocity inside the drum and the water content.

Although the preferred embodiments of the present invention have been described, it is understood that the present invention should not be limited to these preferred embodiments but various changes and modifications can be made by one skilled in the art within the spirit and scope of the present invention as hereinafter claimed.

The invention claimed is:

1. A sterilizable washing method using ultraviolet radiation in a washing machine for washing laundry by rotation of a drum through a washing course including a water supply step, a washing step, a drainage step, a rinsing step and a dehydration step, the method comprising:

a sterilization step for sterilizing the laundry by ultraviolet radiation after the dehydration step, wherein the dehydration step is finished when an air flow velocity inside the drum is below a set value, and wherein the dehydration step discharges wash water contained in the laundry by centrifugal force by rotating the drum at high speed.

2. The sterilizable washing method of claim 1, wherein the sterilization step is accompanied with rotation of the drum.

3. The sterilizable washing method of claim 2, wherein the drum is rotated at a lower speed than a speed (corresponding to a centrifugal force of 1 G) of rotating the laundry, sticking to the drum by centrifugal force generated by rotation.

4. The sterilizable washing method of claim 2, wherein the drum is rotated to be alternately reversed clockwise and counterclockwise.

5. The sterilizable washing method of claim 2, wherein the drum is rotated so that an air flow velocity inside the drum can be equal to or lower than 2 m/sec.

6. The sterilizable washing method of claim 1, wherein the ultraviolet radiation is additionally radiated in at least one step of the washing course.

7. The sterilizable washing method of claim 1, further comprising:

a step for radiating ultraviolet rays, when the laundry is not taken out of the washing machine over a predetermined time after finishing the washing course and the sterilization step.

8. A sterilizable washing method using ultraviolet radiation in a washing machine for washing laundry by rotation of a drum through a washing course including a water supply step, a washing step, a drainage step, a rinsing step and a dehydration step, the method comprising:

a sterilization step for sterilizing the laundry by ultraviolet radiation after the dehydration step, wherein the sterilization step starts when humidity inside the drum is below a set value, and wherein the dehydration step discharges wash water contained in the laundry by centrifugal force by rotating the drum at high speed.

* * * * *